US007416365B2

(12) United States Patent
Mochigi et al.

(10) Patent No.: US 7,416,365 B2
(45) Date of Patent: Aug. 26, 2008

(54) SAFETY DEVICE FOR BACKWARD MOVEMENT OF VIBRATION ROLLER

(75) Inventors: Hideki Mochigi, Hasuda (JP); Tomio Ishikawa, Kasukabe (JP)

(73) Assignee: Mikasa Sangyo Co., Ltd., Tokyo (JP)

( * ) Notice: Subject to any disclaimer, the term of this patent is extended or adjusted under 35 U.S.C. 154(b) by 408 days.

(21) Appl. No.: 10/517,152

(22) PCT Filed: Jun. 18, 2003

(86) PCT No.: PCT/JP03/07738

§ 371 (c)(1),
(2), (4) Date: Jun. 10, 2005

(87) PCT Pub. No.: WO2004/113618

PCT Pub. Date: Dec. 29, 2004

(65) Prior Publication Data

US 2005/0254898 A1 Nov. 17, 2005

(51) Int. Cl.
*E01C 19/28* (2006.01)
*G05G 1/00* (2006.01)

(52) U.S. Cl. ..... 404/131; 404/117; 74/469

(58) Field of Classification Search ..... 404/117, 404/131; 56/14.7, 11.3, 11.4, 11.8, 10.5; 74/483 R, 471.31, 483 K, 483 PB, 469
See application file for complete search history.

(56) References Cited

U.S. PATENT DOCUMENTS 4,702,640 A * 10/1987 Allen ..... 404/75
4,775,263 A * 10/1988 Persson et al. ..... 404/133.1
5,307,910 A * 5/1994 Im ..... 192/13 R
5,385,597 A 1/1995 Polacek
6,327,839 B1 * 12/2001 Velke et al. ..... 56/14.7
6,350,083 B1 * 2/2002 Paladeni ..... 404/118
6,382,383 B1 5/2002 Schennach
6,409,425 B1 * 6/2002 Okabe et al. ..... 404/117
6,516,596 B2 * 2/2003 Velke et al. ..... 56/14.7
6,550,563 B2 * 4/2003 Velke et al. ..... 180/333
2003/0068201 A1 * 4/2003 Wynings ..... 404/131

FOREIGN PATENT DOCUMENTS

JP 2-127691 7/1992
JP 6-507691 A 9/1994
JP 2002-501135 A 1/2002

* cited by examiner

*Primary Examiner*—Raymond W Addie
(74) *Attorney, Agent, or Firm*—Frishauf, Holtz, Goodman & Chick, P.C.

(57) ABSTRACT

The present invention provides a safety device of vibration roller wherein a travel switching device of the roller is switched to a neutral position automatically and the roller stops automatically when the operator is caught between the roller and an obstacle, and a safety switch is activated, even if the travel lever is placed in the reverse position continuously.

A back end (16*a*) of an outer tube of an operation cable (7) is locked in front of the travel lever (4) in the case (2) when a safety switch (22) is not activated, the back end (16*a*) of the outer tube is released and displaced to a direction of the travel lever (4) when the safety switch (22) is activated.

20 Claims, 3 Drawing Sheets

SAFETY DEVICE FOR BACKWARD MOVEMENT OF VIBRATION ROLLER

This application is a U.S. National Phase Application under 35 USC 371 of International Application PCT/JP03/07738 filed Jun. 18, 2003.

TECHNICAL FIELD

The present invention relates to an improvement of vibration rollers used for paving and having a emergency stop device (dead man's controller) at the rear of the roller for preventing an accident when moving backward.

BACKGROUND-ART

Conventionally, vibration rollers used for repairing paved roads and others have a emergency stop device for preventing the operator from being caught between the roller and an unnoticed obstacle behind him when the roller moves backward. The emergency stop device stops reverse travel of the roller by switching a travel lever on an operating portion of the rear of the roller to a neutral position when the operator hits the obstacle and touches a safety switch sticked out of the operating portion.

In the conventional emergency-stop-device, when the operator hits the obstacle and the safety switch is activated while the roller moves backward, the travel lever on the operating portion is displaced to the neutral position and the travel switching device of the roller is switched to a neutral position, therefore, the reverse travel of the roller is stopped automatically. Accordingly, this kind of conventional emergency-stop-device is considered to theoretically ensure safety of the operator.

However, in fact, although the safety switch is turned on, when the operator hits the obstacle and the emergency stop device is activated, so that the travel lever on the operating portion may be switched from a reverse position to the neutral position, the roller does not stop and an accident in which the operator is seriously injured by being caught between the obstacle and the roller happens.

The reason of that, according to research, is turned out as follows. The reason is that the operator holds the travel lever in the reverse position while the roller moves backward, therefore, when he hits the obstacle behind him, he keeps tightly the travel lever in the reverse position in shock without releasing it. Accordingly, the roller does not stop and keeps on moving backward although the emergency stop device is activated and intends to switch the travel lever on the operating portion from the reverse position to the neutral position.

As means for solving this problem, the mechanics of the emergency stop device stopping the roller is advocated in the related art (for example, Japanese Patent Application KOHYO Publication No. 2002-501135). The emergency stop device in the related art stops the roller moving backward; when the operator hits the obstacle behind him, the safety switch is activated, and the travel switching device of the roller is switched automatically to the neutral position; although the operator holds tightly the travel lever in the reverse position in shock.

In the emergency stop device, when the operator hits the obstacle behind him while the roller moves backward, a conical top of the safety switch is pressed into between a travel lever coupled like a clutch and an adjusting element, and separates the travel lever and the adjusting element. Therefore, even if the travel lever is placed in the reverse position, the adjusting element is pulled to the neutral position regardless of the position of the travel lever, thus, the roller stops automatically.

The emergency stop device has a mechanism in which a conical top like a pencil of the safety switch is disposed in back of a narrow gap between the travel lever coupled like a clutch and the adjusting element, the switch is activated after the conical top of the safety switch is pulled into between the travel lever and the adjusting element, and the switch separates them. Therefore, the emergency stop device has problems. The problems are that, if the conical top of the safety switch is not disposed with a proper height and a proper angle for the gap between the travel lever and the adjusting element, the emergency stop device does not work properly because the conical top of the safety switch pulled into between the travel lever and the adjusting element cannot separate them properly, and the travel lever is held in the reverse position continuously.

DISCLOSURE OF THE INVENTION

An object of the present invention is to provide a safety device of vibration rollers, when it moves backward, in order to solve problems in the related art such as described above.

Accordingly, in the present invention, the travel switching device of the roller is switched to the neutral position automatically and the roller stops automatically when the operator is caught between the roller and the obstacle, and the safety switch is activated, even if the travel lever is placed in the reverse position continuously.

As specific means for that; in a vibration roller which has a travel lever on an operating portion operating forward, neutral, and reverse of the roller; and a safety switch for preventing the operator from being caught between the roller and the obstacle when moving backward; a safety device of the roller of the present invention includes a operation cable connecting the travel lever and a travel switching device, a front end and a back end of an outer tube of the operation cable are supported on a side of the travel lever and on a side of the travel switching device respectively under a condition that the outer tube is bent, the back end of the outer tube is locked in front of the travel lever while the safety switch is not activated, the back end of the outer tube is released and extended to a direction of the travel lever when the safety switch is activated.

It is preferable that a locking mechanism which locks the back end of the outer tube into the operating portion comprises a turning plate, wherein a bottom of which is fixed axially in the front part in the operating portion so as to be pivotable forward and backward for the roller, an oscillating plate fixed axially on both sides of a top of the turning plate under a condition that the back end of the outer tube is supported so as to be pivotable, and a cam for locking the turning plate in locking position.

Moreover, it is preferable that the cam of the locking mechanism is provided at a front end of the safety switch, a bottom of the cam is pulled backward by forces of a spring when the safety switch is not activated, and a top of the cam pushes and locks the turning plate for preventing the turning plate turning to a direction of the travel lever.

Furthermore, it is preferable in the turning plate that a inclined concave-portion is provided on a back side of the turning plate contacted by the cam provided at the front end of the safety switch so that the turning plate can turn in a proper angle with touching the cam when a lock of the back end of the outer tube is released by turning of the turning plate.

BEST MODE FOR CARRYING OUT THE INVENTION

Figure 1:
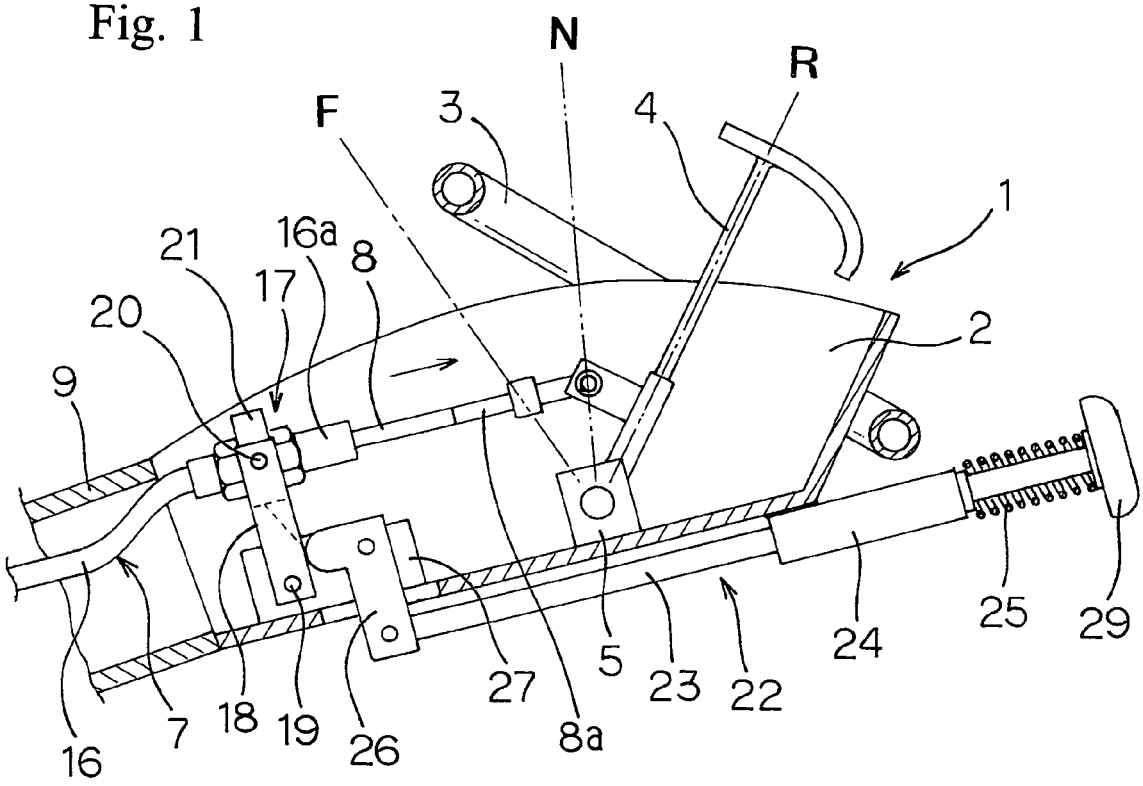
FIG. 1 is a cross sectional view showing a inside of a case of the operating portion mounted at a rear of the roller.

The mechanics of the safety device of vibration roller will be described by referring drawings. FIG. 1 is a cross sectional view showing the inside of a case 2 of an operating portion 1 mounted at the rear of the roller. An operating handle 3 is provided at the rear of the case 2 (at the near side for the operator, the right side in FIG. 1), the bottom of a travel lever 4 in the case 2 operating forward F, neutral N, and reverse R of the roller is fixed axially in a bearing 5 so as to be pivotable forward and backward.

Figure 2:
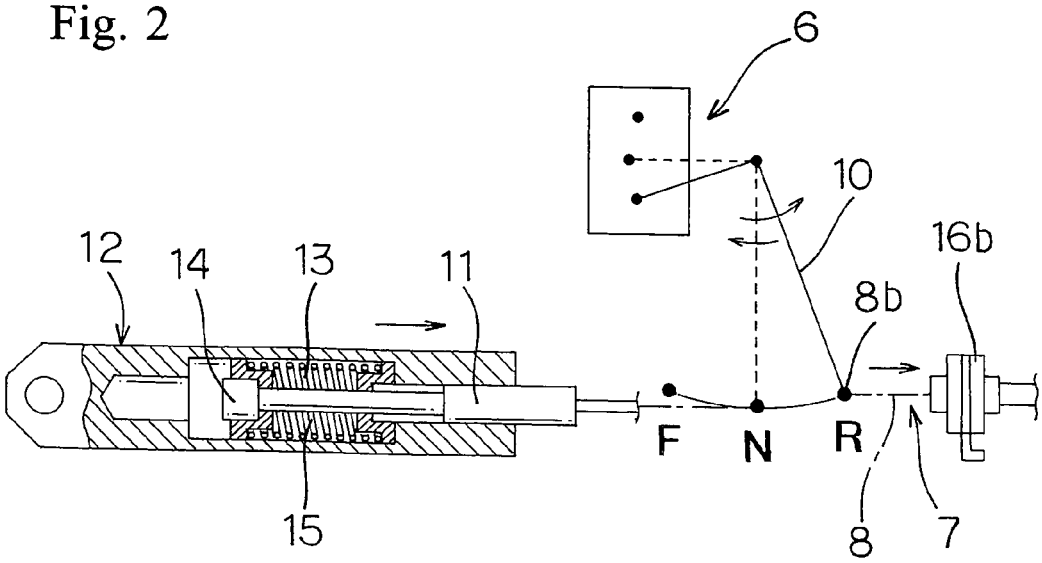
FIG. 2 is a drawing for explaining a structure of the travel switching device at a front of the roller.

A back-end rod 8*a* of an inner wire 8 in a operation cable 7 extended from a travel switching device 6 of the roller, shown in FIG. 2, is connected to a part of the travel lever 4 above the bearing 5. In a state shown in FIG. 1, the travel lever 4 is turned to the rear of the case 2 (at the near side for the operator, the right side in FIG. 1), then the inner wire 8 is pulled, therefore, the travel switching device 6 shown in FIG. 2 is displaced to reverse position R, then the roller moves backward.

FIG. 2 shows the travel switching device 6 on the roller connected to the operating portion 1 via an operating arm 9 shown in FIG. 1. A lever 10 of the travel switching device 6 is connected to a front-end 8*b* of the inner wire 8 in the operation cable 7. As shown in FIG. 1, since the travel lever 4 is placed in reverse R position, the inner wire 8 is pulled to the right in the figure and the lever 10 of the travel switching device 6 is placed in the reverse R position as well.

The travel switching device 6 has a plunger 12 known publicly at the end of the lever 10 via a rod 11. As shown in FIG. 2, the plunger 12 is assembled so that a piston 14 fixed at the end of the rod 11 may be always disposed in neutral N position by the forces of a spring 13 disposed in a chamber 15.

Accordingly, FIG. 2 shows a state of the rod 11 pulled to a direction of reverse R (to the right) while the rod 11 receives the forces intending to return to a direction of neutral N (to the left) by the spring 13, and the roller moves backward.

Correspondingly, not shown in figures, when the lever 10 is placed in a forward F position and the rod 11 is displaced to a direction of forward F, the rod 11 always intends to return to the neutral N position by receiving the forces of the spring 13.

In the meantime, at the front in the case 2 of the operating portion 1 (the left side in FIG. 1), a locking mechanism 17 which locks a back end 16*a* of an outer tube 16 of the operation cable 7 extended from the travel switching device 6 of the roller in place in the case 2 is provided.

Figure 3:
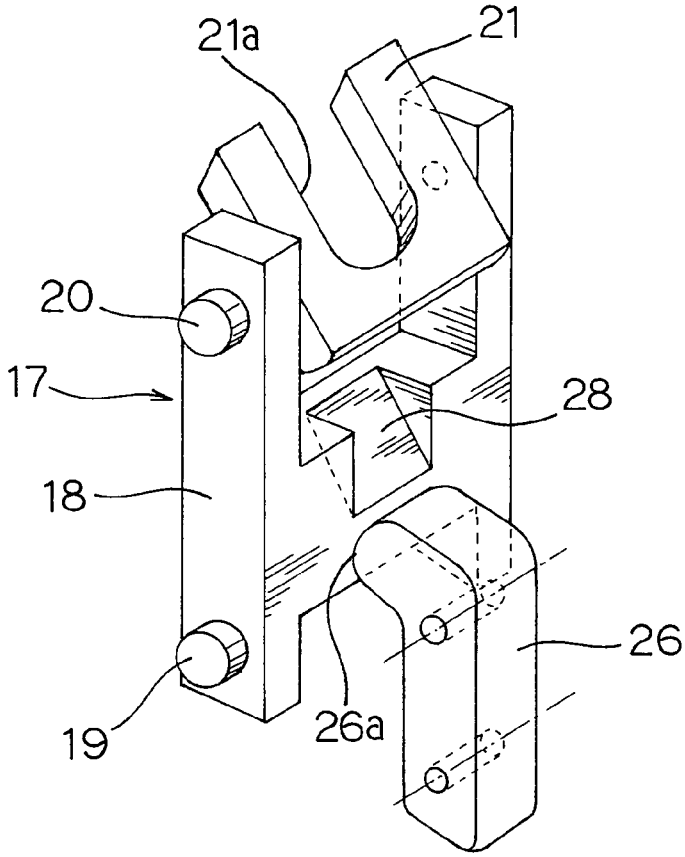
FIG. 3 is a perspective view showing a structure of the locking mechanism at the back end of the outer tube.

The locking mechanism 17, as shown in FIG. 1 and FIG. 3, is composed of a turning plate 18, the bottom of which is fixed on a shaft 19 so as to be pivotable forward and backward for the roller at the front part in the case 2, an oscillating plate 21 fixed axially on a shaft 20 so as to be pivotable on the both sides of the top of the turning plate 18, and a cam 26 for locking the turning plate 18 in locking position.

As shown in FIG. 3, the turning plate 18 has a inclined concave-portion 28 on the side where the cam 26 is disposed so that the turning plate 18 may turn in a proper angle with touching the cam when the lock is released. The back end 16*a* of the outer tube 16 is fitted and fixed in an U-shaped incision 21*a* of the oscillating plate 21. As shown FIG. 4, the oscillating plate 21 is fixed on the turning plate 18 so that it may rotate naturally around the shaft 20 when the turning plate 18 turns forward or backward about the shaft 19.

A sleeve 24 and a rod 23 of a safety switch 22 are disposed under the case 2. The rod 23 penetrated into the sleeve 24 receives forces by a spring 25 disposed at the rear of the sleeve 24, and the forces acts toward the rear (the right side in FIG. 1). The bottom of the cam 26 is connected to the top of the rod 23 (the left side in FIG. 1).

A slightly upper part of the cam 26 is fixed axially in a pedestal 27 in the case 2. As mentioned above, since the rod 23 is pushed to the rear of the case 2 (the right side in FIG. 1) by the forces of the spring 25, the bottom of the cam 26 is pulled to the right side in FIG. 1, then the top of the cam 26 pushes a front face of the turning plate 18 to the left. Accordingly, the cam 26 stops the turn of the turning plate 18 around the shaft 19 toward the rear (the right side in FIG. 1) and fixes firmly the back end 16*a* of the outer tube 16 in the case 2.

In addition, as shown in FIG. 2, the front end 16*b* of the outer tube 16 of the operation cable 7 is fixed at a part of the roller having the travel switching device 6 through the inside of the operating arm 9 connected to the case 2 shown in FIG. 1. In this case; since the outer tube 16 is disposed between the case 2 and the travel switching device 6 through the inside of the operating arm 9, the front end 16*b* is fixed at the roller side, and the back end 16*a* is disposed so that it may be fixed by the locking mechanism 17 in the case 2; as shown in FIG. 5, the outer tube 16 is disposed with wholly bended, not straight.

As mentioned above, since the outer tube 16 is displaced between the case 2 and the travel switching device 6 under the condition that the back end 16*a* and the front end 16*b* is fixed, when the travel lever 4 is displaced to the reverse R position as shown in FIG. 1, the inner wire 8 is pulled out from the back end 16*a* being under fixed condition to the direction of reverse R about the travel lever 4 through the inside of the outer tube 16. At the same time, as mentioned above, the lever 10 of the travel switching device 6 is pulled to the direction of reverse R, then the roller moves backward.

Figure 5:
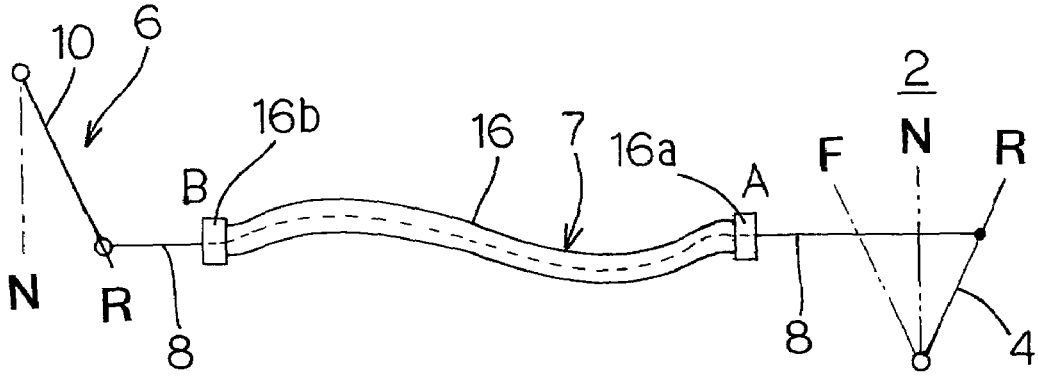
FIG. 5 is a drawing for explaining a relation the travel lever and the travel switching device when the roller moves backward under a condition that the both sides of the outer tube is fixed.

FIG. 5 shows a condition of the roller moving backward where the travel lever 4 is displaced to the reverse R position under the condition that the both ends 16*a* and 16*b* of the outer tube 16 is fixed between A and B and the lever 10 of the travel switching device 6 is pulled to the reverse R position.

Figure 4:
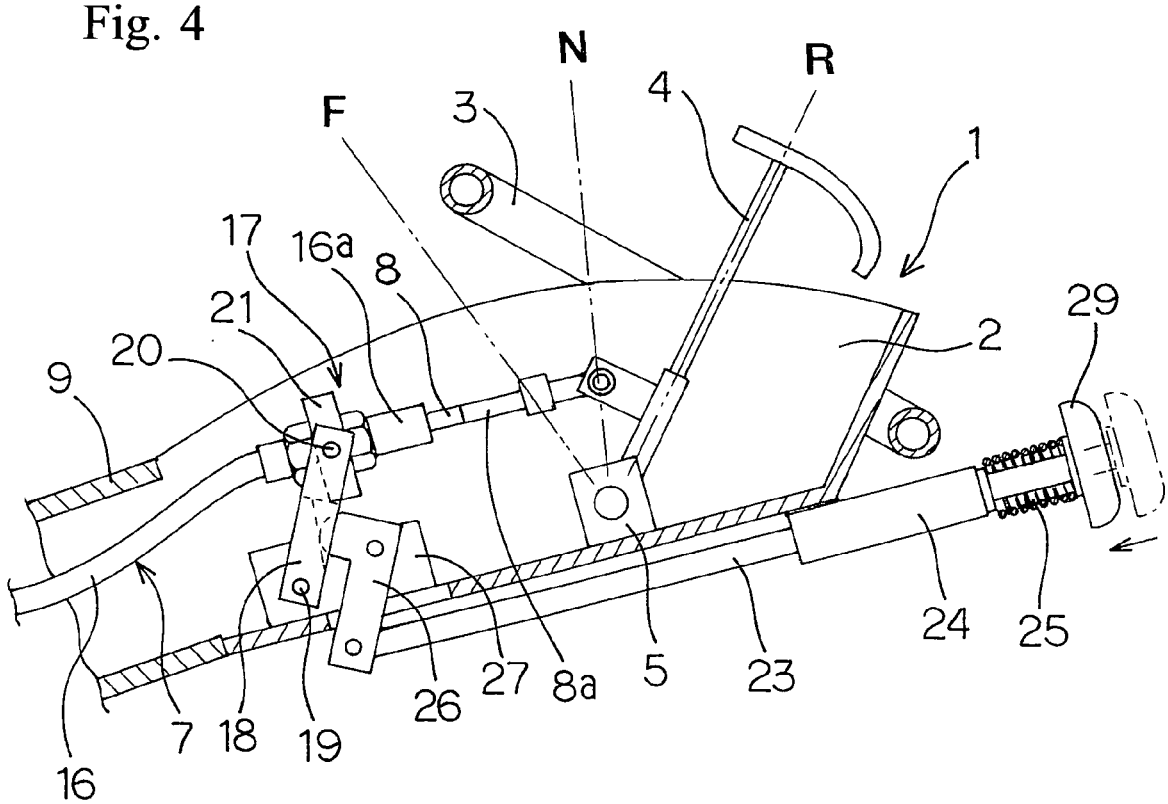
FIG. 4 is a cross sectional view showing a state where the safety switch is activated in the same part of FIG. 1.

If the operator hits the obstacle behind him when the roller moves backward, as shown in FIG. 4, a push plate 29 of the back end of the rod 23 of the safety switch 22 hits a body of the operator, then the spring 25 is compressed, and the rod 23 is pulled out to the left, and then the bottom of the cam 26 on the top of the rod 23 is pulled to the same direction. Accordingly, the top of the cam 26 falls backward (right), and the turning plate 18 supporting the back end 16*a* of the outer tube 16 turns to a direction of the travel lever 4, then the lock condition where the back end 16*a* of the outer tube 16 is fixed in position in the case 2 is released.

Figure 6:
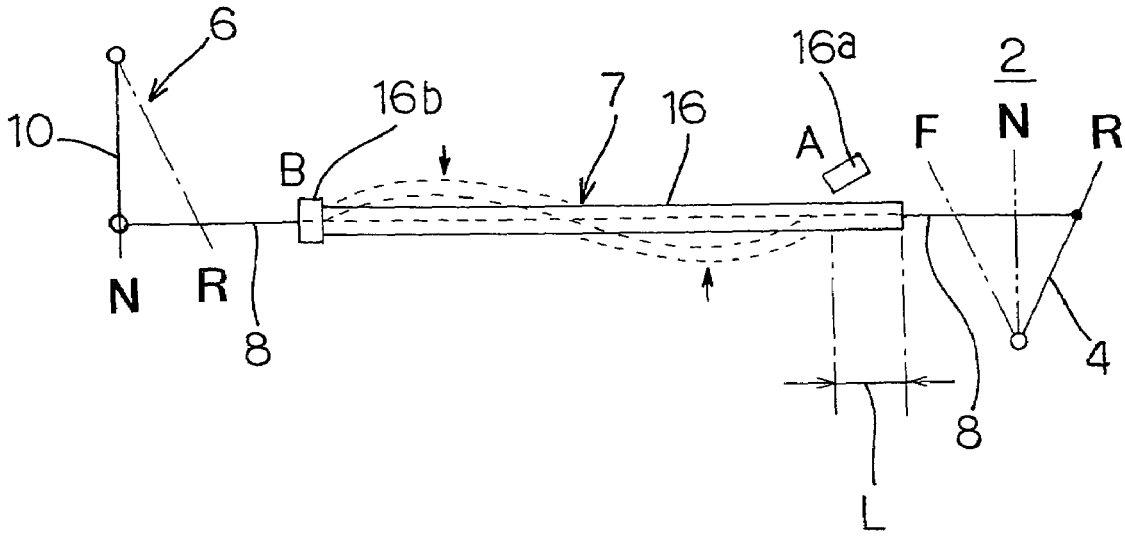
FIG. 6 is a drawing for explaining a relation the travel lever and the travel switching device when the back end of the outer tube is released.

FIG. 6 shows a condition of the back end 16*a* of the both ends, shown as A and B in FIG. 5, of the outer tube 16 when the lock condition is released by the locking mechanism 17. As shown in FIG. 6, if the lock condition of the back end 16*a* of the outer tube 16 is released, the outer tube 16 is extended to L which is corresponding to the moving length of the turning plate 18 toward the direction of the travel lever 4.

Accordingly, since the bended outer tube 16 as shown in FIG. 5 become a straight one, the inner wire 8 penetrated into the tube 16 intends to expand to any direction. However, the inner wire 8 cannot expand toward the direction of the travel lever 4 because the travel lever 4 is placed in the reverse R position. Therefore, the inner wire 8 expands toward a direction of the travel switching device 6.

In the meantime, the travel switching device 6, as mentioned above, always has the forces intending to return to the neutral N direction, therefore, even if the travel lever 4 on the operating portion 1 is placed in the reverse R position and the operator holds the travel lever 4 in the reverse R position in shock, the inner wire 8 expands toward the direction of the travel switching device 6 and is pulled to the neutral N position as shown in FIG. 6, and the roller stops automatically.

Moreover, in order to move the roller forward after the safety switch was activated and the roller stopped, only displacing the travel lever 4 from the reverse R position to the forward F position will suffice. Accordingly, the travel lever 4 is displaced to the forward F position shown in FIG. 1, and displaces the inner wire 8 and the lever 10 of the travel switching device 6 to the forward F position, therefore, the roller moves forward and the operator can escape from between the roller and the obstacle.

After the operator escape from the rear of the roller, the forces compressing the spring 25 of the safety switch 22 is released, therefore, the safety switch 22 returns to the condition shown FIG. 1, the back end 16*a* of the outer tube 16 is locked in position again, and the roller can be operated regardless of the activation of the safety switch.

INDUSTRIAL APPLICABILITY

The safety device of vibration roller of the present invention holds the back end of the outer tube of the operation cable operating the travel of the roller by the locking mechanism under normal conditions, and releases the lock of the back end of the outer tube when the safety switch is activated while the roller moves backward. Accordingly, when the safety switch is activated while the roller moves backward, the locked state of the inner wire by the outer tube is released and the inner wire intends to return to the neutral position.

Moreover, since the travel switching device also provides the rod of the plunger with forces intending to return automatically to the neutral position, the roller stops automatically when danger occurs even if the travel lever is placed in reverse, therefore, the accident can be prevented absolutely.

Furthermore, after the safety switch is activated and the roller stops, by just displacing the travel lever to the forward position, the roller can move forward. Thus, the operator can be rescued safely and immediately. Moreover, after the operator is rescued from the rear of the roller, the safety switch is returned and the back end of the outer tube is locked automatically. Therefore, the safety device has the advantage of being easy to use.

In addition, according to the safety device, safety when the roller moves backward is ensured only by locking, it is due to the activation of the safety switch, the back end of the outer tube or only by unlocking the back end of the outer tube. Therefore, compared to devices such as conventional emergency-stop-devices in which the safety switch is required to be always disposed with a proper height and a proper angle for pushing the travel lever into the gap between the travel lever and the adjusting element, the safety device has a simple structure and a easy handling.

What is claimed is:

1. A vibration roller comprising:

an operating portion;

a travel lever on the operating portion for controlling forward, neutral, and reverse operation of the roller;

a safety switch for preventing an operator from being caught between the roller and an obstacle when moving backward;

a travel switching device; and a safety device including:

a operation cable connecting the travel lever and the travel switching device, wherein the operation cable includes a bendable outer tube having a front end and a back end, and the front end of the outer tube is supported on a side of the travel lever and the back end of the outer tube is supported on a side of the travel switching device, the back end of the outer tube being locked in front of the travel lever while the safety switch is not activated, and the back end of the outer tube being released and extended in a direction of the travel lever when the safety switch is activated.

2. The roller as claimed in claim 1, further comprising a locking mechanism which locks the back end of the outer tube into the operating portion, wherein the locking mechanism comprises:

a turning plate having a bottom fixed axially in a front part in the operating portion so as to be pivotable forward and backward of the roller;

an oscillating plate fixed axially on both sides of a top of the turning plate under a condition that the back end of the outer tube is pivotally supported; and a cam for locking the turning plate in a locking position.

3. The roller as claimed in claim 2, wherein the cam of the locking mechanism is provided at a front end of the safety switch, a bottom of the cam is pulled backward by forces of a spring when the safety switch is not activated, and a top of the cam pushes and locks the turning plate for preventing the turning plate from turning in a direction of the travel lever.

4. The roller as claimed in claim 3, wherein an inclined concave-portion is provided on a back side of the turning plate contacted by the cam provided at the front end of the safety switch so that the turning plate can turn in a proper angle while touching the cam when a lock of the back end of the outer tube is released by turning of the turning plate.

5. The roller as claimed in claim 2, wherein an inclined concave-portion is provided on a back side of the turning plate contacted by the cam provided at the front end of the safety switch so that the turning plate can turn in a proper angle while touching the cam when a lock of the back end of the outer tube is released by turning of the turning plate.

6. The roller as claimed in claim 1, wherein the operation cable includes an inner wire, and the outer tube is arranged around the inner wire.

7. The roller as claimed in claim 6, wherein the outer tube is arranged to bend relative to the inner wire such that when the back end of the outer tube is extended upon activation of the safety device, the inner wire expands in a direction of the travel switching device to cause the travel switching device to switch the roller from reverse to neutral.

8. The roller as claimed in claim 6, wherein a back end of the inner wire is connected to the travel lever.

9. The roller as claimed in claim 8, wherein a front end of the inner wire is connected to the travel switching device.

10. The roller as claimed in claim 9, wherein the travel switching device includes a lever, and the back end of the inner wire is connected to the lever of the travel switching device.

11. The roller as claimed in claim 6, wherein the outer tube and the inner wire are movable relative to each other.

12. The roller as claimed in claim 1, wherein the operation cable is positioned between the travel lever and the travel switching device and coupled to the travel lever and the travel switching device to enable bending of the operation cable.

13. The roller as claimed in claim 1, further comprising a locking mechanism coupled to and selectively locking the back end of the outer tube.

14. The roller as claimed in claim 13, wherein the safety switch is arranged to interact with the locking mechanism to enable release of the locking of the back end of the outer tube when the safety switch is activated.

15. The roller as claimed in claim 13, wherein the operation cable includes an inner wire, the outer tube is arranged around the inner wire, and a back end of the inner wire is connected to the travel lever.

16. The roller as claimed in claim 15, wherein a front end of the inner wire is connected to the travel switching device.

17. The roller as claimed in claim 13, wherein the locking mechanism supports the back end of the outer tube.

18. The roller as claimed in claim 13, wherein the locking mechanism includes an oscillating plate having an opening for receiving the outer tube.

19. The roller as claimed in claim 13, further comprising a case, wherein the operating portion and the locking mechanism are arranged partly inside the case.

20. The roller as claimed in claim 13, wherein the locking mechanism is situated between the travel lever and the travel switching device.

* * * * *